US006009184A

United States Patent [19]

Tate et al.

[11] Patent Number: 6,009,184

[45] **Date of Patent: *Dec. 28, 1999**

[54] NOISE CONTROL DEVICE FOR A BOOM MOUNTED NOISE-CANCELING MICROPHONE

[75] Inventors: Joseph B. Tate, Sausalito; Steven B. Wolff, Woodacre, both of Calif.

[73] Assignee: Umevoice, Inc., Novato, Calif.

[ * ] Notice: This patent is subject to a terminal disclaimer.

[21] Appl. No.: 09/115,529

[22] Filed: Jul. 13, 1998

Related U.S. Application Data

[63] Continuation-in-part of application No. 08/787,010, Jan. 29, 1997, Pat. No. 5,854,848, which is a continuation-in-part of application No. 29/060,838, Oct. 8, 1996, Pat. No. Des. 396,235.

[51] Int. Cl.[6] ..... H04R 1/34; H04R 1/38

[52] U.S. Cl. ..... 381/357; 379/433

[58] Field of Search ..... 381/357, 361, 381/362, 355, 160, 91, 356; 379/433

[56] References Cited

U.S. PATENT DOCUMENTS

| | | | |
|---|---|---|---|
| 5,268,965 | 12/1993 | Badie et al. . | |
| 5,282,245 | 1/1994 | Anderson . | |
| 5,329,593 | 7/1994 | Lazzeroni et al. . | |
| 5,341,420 | 8/1994 | Hollier et al. . | |
| 5,394,467 | 2/1995 | Kepley, III et al. . | |
| 5,448,637 | 9/1995 | Yamaguchi et al. . | |
| 5,854,848 | 12/1998 | Tate et al. | 381/357 |

*Primary Examiner*—Minsun Oh Harvey

*Attorney, Agent, or Firm*—Burns Doane Swecker and Mathis LLP

[57] ABSTRACT

An apparatus for noise cancellation of ambient noise impinging upon the front surface of a pressure differential microphone on the end of a boom. The apparatus utilizes curved reflectors to cause ambient noise which impinges on the front surface of the microphone to also impinge on the back surface of the microphone. In addition, the curved reflectors cause a talker's voice which is directed toward the front surface of the microphone to be deflected away from the back surface of the microphone.

13 Claims, 6 Drawing Sheets

NOISE CONTROL DEVICE FOR A BOOM MOUNTED NOISE-CANCELING MICROPHONE

CROSS-REFERENCE TO RELATED APPLICATIONS

This application is a continuation-in-part of U.S. Ser. No. 08/787,010, filed on Jan. 29, 1997, now 5,854,848 which is a continuation-in-part of U.S. Ser. No. 29/060,838, filed on Oct. 8, 1996 now D.396,235.

BACKGROUND OF THE INVENTION

This invention relates generally to noise-canceling microphones and related devices. More particularly, this invention relates to a bi-directional noise control device for use with boom mounted noise-canceling microphones in environments having random noise.

Microphone units typically operate in environments where unwanted noise is present. For example, a person listening to a receptionist using a telephone headset with a boom mounted microphone may be distracted from the receptionist's voice by sounds emanating from machinery, traffic, appliances, or other ambient sounds, if the receptionist is talking into a headset without a noise-canceling microphone.

Many noise-canceling microphone element designs employ front and rear sound ports which allow sound to enter both front and rear and impinge upon the diaphragm simultaneously in opposite directions resulting in little or no signal being generated by the microphone. This technique is applied in a wide variety of cardioid microphones as well as telephone handset transmitters and headsets. Some employ acoustic tuning to the rear port to make it more frequency responsive.

Noise-canceling microphones depend upon two factors for their operation. The first factor is the polar pattern of the microphone (usually bi-directional) and the assumption that the noise to be reduced is not on the maximum sensitivity axis of the microphone. The second factor is the different responses of the bi-directional microphone for a sound source close to the microphone (i.e., entering the front sound port) and a sound source at a relative distance from the microphone (i.e., entering the front and rear sound port).

When the sound source is close to the front sound port of the microphone, the sound pressure will be several times greater at the front than at the rear. Since the microphone responds to the difference of sound pressure at the two entries, close talking will provide a substantially higher sensitivity than a remote sound, where the sound pressure is equal in magnitude at the two entries.

Because of construction restraints inherent in front and rear sound port microphone design, one port of the microphone is always more sensitive. This results from the need to provide a supporting structure for the diaphragm and the resulting impedance that structure presents to sound entering the rear sound port microphone element. In common practice, the more sensitive port is faced forward to capture the desired sound while the less sensitive port is utilized for capturing and nulling the undesired background noises.

If the front and back sensitivities of the element were equal, then theoretically 100% noise rejection would be possible whenever noise of equal pressure enters both entrances of the microphone. In practice however, only 10–20 dB noise reduction is possible using the currently available microphone elements and this is only for frequencies below about 3 KHz.

Frequency response is another factor that differentiates noise-canceling microphones. Frequency response is essentially flat in the near field (i.e., for a sound source close to the front sound port on the talker's voice side of the microphone) over the audio band. In the far field (i.e., for a remote sound source), the frequency response increases with frequency until the pressures at the front and rear ports of the unit are 180 degrees out of phase at which point resonance occurs. At some frequency, the microphone becomes more sensitive to axial far field sounds than axial near field sounds. This crossover frequency will occur at a higher frequency for a microphone with a shorter port separation than a microphone with a longer port separation.

Several devices, both electrical and mechanical, used for noise-cancellation exist but have potential drawbacks such as the need for preprocessing, effects of reflections, calibration difficulties, cost, and operating environment. For example, in environments in which human speech is the ambient noise, signal processing techniques such as filtering can not effectively be used because the ambient human speech is at the same frequency as the desired speaker's voice and because the ambient noise is non-constant or non-periodic.

BRIEF SUMMARY OF THE INVENTION

The apparatus of the present invention enhances the performance of pressure differential microphones on the end of a boom used to cancel or reject background noise. When the pressure differential microphone and the apparatus of the present invention are used together on the end of a boom they form an electroacoustic noise rejection system exceeding the performance of commercially available technologies.

The present invention effects a high degree of cancellation of the impingement of ambient noise upon the front surface of a pressure differential microphone on a boom by directing the same ambient noise upon the back side of the microphone. The present invention for a boom-type microphone causes ambient noise (including voice, non-constant noise, non-periodic noise, and random noise) to enter the microphone on both sides simultaneously and with the strength of the sound on the back side relatively higher slightly to overcome the relatively higher impedance of the back side of the microphone, thus nullifying the effect of the noise sound waves. Furthermore, the present invention for a boom-type microphone deflects the talker's voice (i.e., the desired sound to be transmitted) away from the back side of the microphone.

The present invention is configured to be attached to the end of a boom and utilizes curved reflectors to direct ambient noise into the back side of the microphone even when the rear port of the microphone is not aligned with the source of greatest ambient noise. In addition, the sound pressure of the ambient noise entering the back side of the microphone is increased by the curved reflectors being larger than the opening leading to the back side of the microphone. By such an invention, ambient noise sound waves entering the front of the microphone are canceled at the microphone by the same ambient noise converging upon the back surface of the microphone. The curved reflectors also act to deflect the speaking voice away from the back side of the microphone so that the speaker's voice enters the front side of the microphone only. This is essentially to reduce or prevent self-cancellation.

In one aspect, the present invention provides a noise-controlling apparatus for use with a directional microphone. The apparatus having a support arm and a housing mounted on the support arm. The housing having a first sound opening located in a front side of a barrier element and a second sound opening located in a back side of the barrier element. The housing having a curved reflector extending from the back side of the barrier element which reflects a user's voice away from the second sound opening and reflects ambient noise toward the second sound opening.

In another aspect, the present invention provides a noise-controlling apparatus having a microphone having a sound-receiving front side and a sound-receiving back side. The microphone being located in a housing. The housing being mounted on a boom and having a centrally located barrier element with a first sound opening in a front side of the barrier element and a second sound opening in a back side of the barrier element communicating with the sound-receiving front and back side, respectively, of the microphone and portions for reflecting a user's voice away from the second sound opening and reflecting ambient noise toward the second sound opening.

DETAILED DESCRIPTION OF THE INVENTION

The apparatus 20 of the present invention improves the noise cancellation effects of pressure differential microphones (i.e., bi-directional microphones) 22 mounted on the end of a boom 32 for voice recognition and speech transmission when used in noisy environments. The term "boom" used throughout in the description and the claims encompasses supporting arms and braces that are generally cantilevered from a base or pivotable connection. The present invention can be used with headsets, as is used as the example herein, in speech recognition systems as well as in any number of a variety of environments and devices, such as but not limited to cellular telephones with boom-type microphones, car phones with boom microphones, telephone headsets, and stage microphones mounted on a boom. The present invention works particularly well in environments having random ambient human speech noise, non-periodic noise, or non-constant noise but is also applicable to environments in which the ambient noise is constant or periodic and not speech noise. The present invention improves voice recognition and speech transmission clarity by enhancing the signal to noise ratio over a frequency range up to 8 KHz, as opposed to conventional devices that generally range up to 4 KHz or less.

Figure 3:
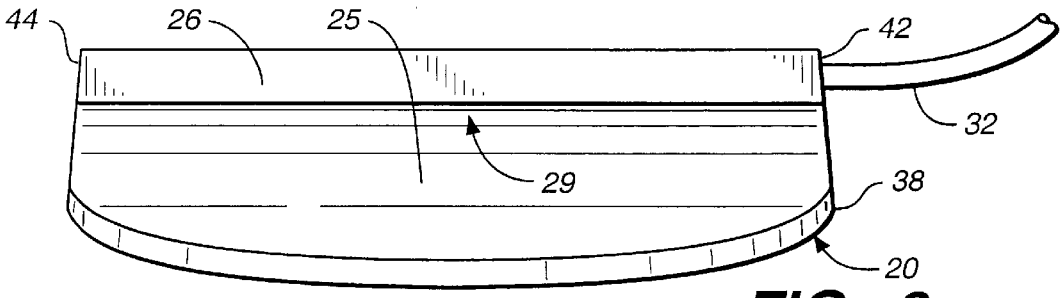
FIG. 3 is a left side view of the apparatus without the boom shown for clarity.
Figure 4:
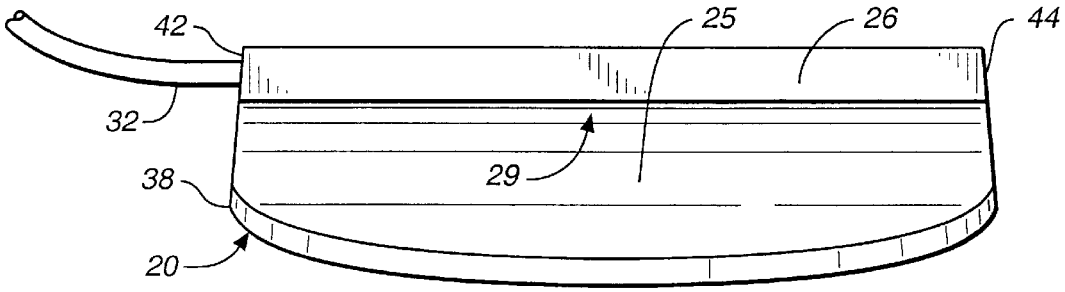
FIG. 4 is a right side view of the apparatus.
Figure 5:
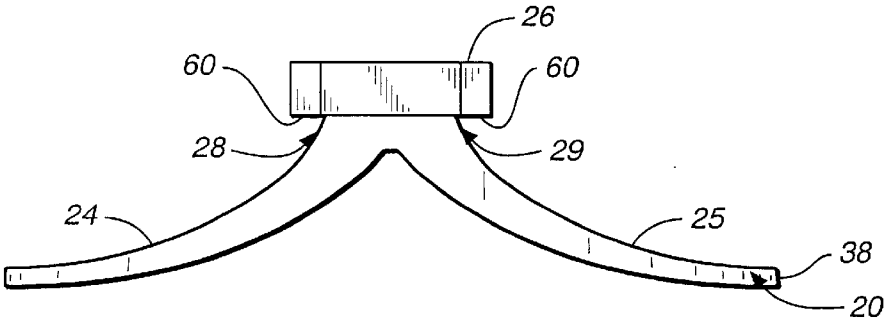
FIG. 5 is a front elevational view of the apparatus mounted on the boom.
Figure 6:
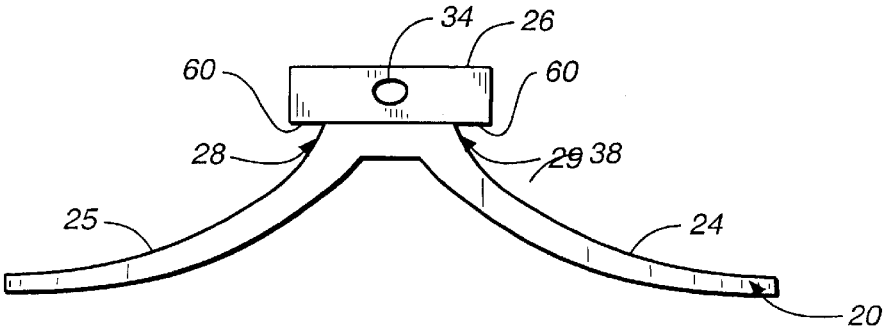
FIG. 6 is a rear elevational view of the apparatus mounted on the boom.

The illustrated embodiment of the apparatus 20 is mounted on a boom 32 of a standard telephone headset 30. The apparatus 20 of the present invention concentrates ambient noise on the rear port (not shown) of a pressure differential microphone 22 as described above while reflecting the speaker's voice away from the rear port using a pair of curved reflectors 24 and 25 and a sound barrier element 26. The barrier element 26 extends across the width (i.e., the x-direction) of the apparatus 20 and forms a pair of open sound concentration zones 28, 29 (FIGS. 3 and 4) with the curved reflectors 24 and 25. These features are illustrated in cross-section in FIGS. 7, 8 and 9.

Figure 1:
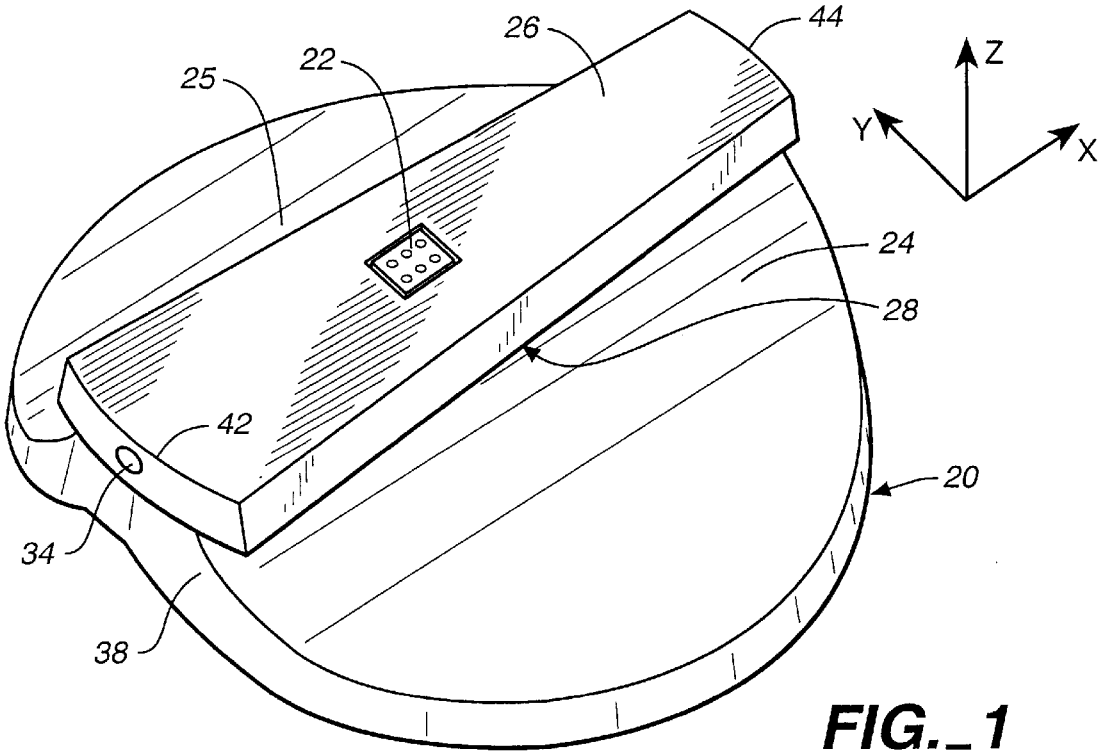
FIG. 1 is a perspective view of the apparatus of the present invention shown without the boom for clarity.
Figure 2:
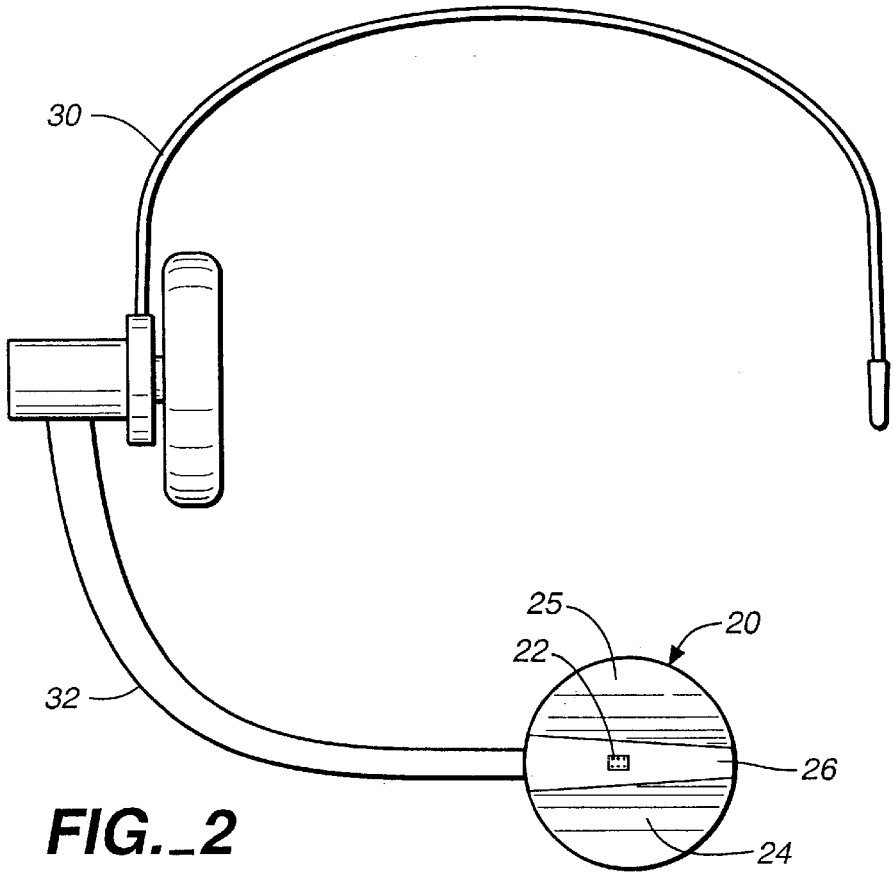
FIG. 2 is a plan view of the apparatus mounted on a boom of a headset.
Figure 2A:
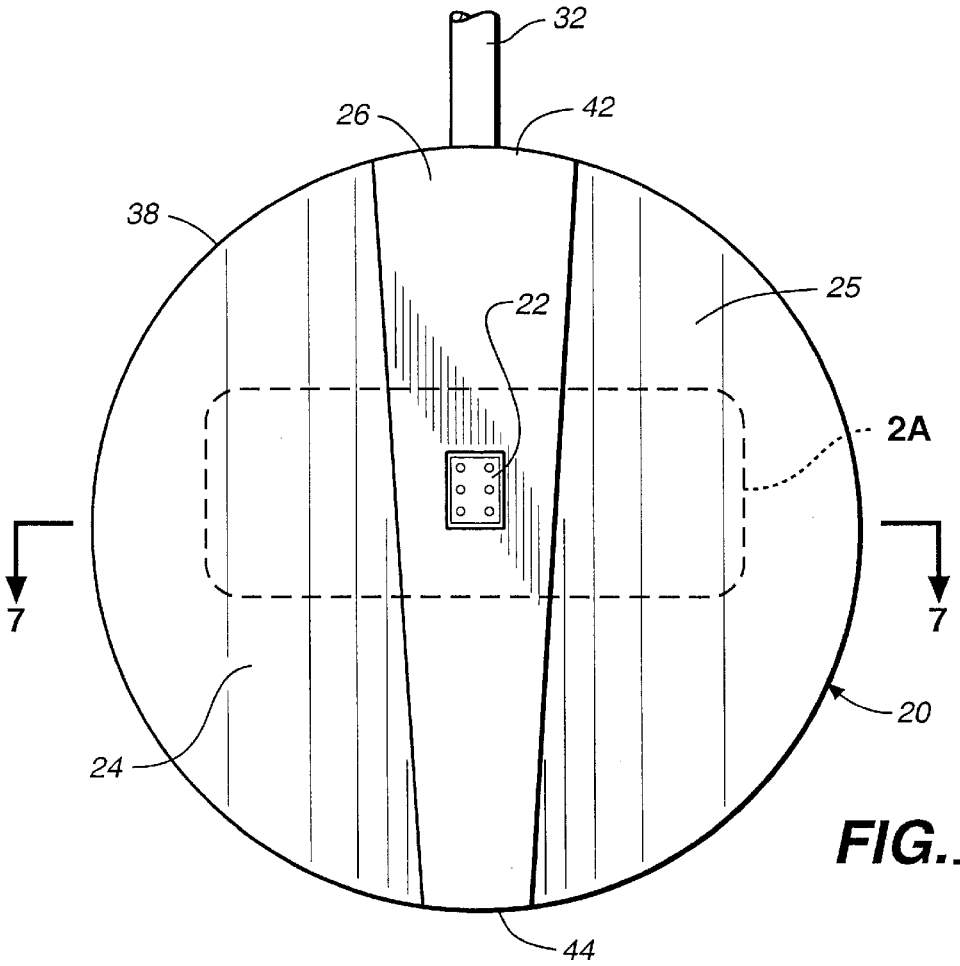
FIG. 2A is a top plan view of the apparatus mounted on the boom.
Figure 2B:
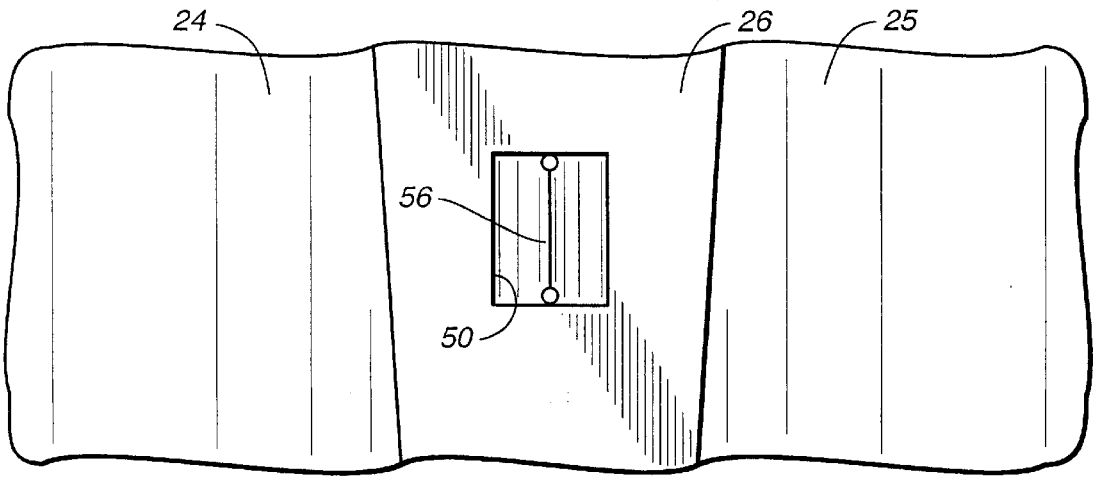
FIG. 2B is an enlarged top plan view of the portion 2A of FIG. 2 with the microphone removed from the opening in the top of the apparatus.
Figure 7:
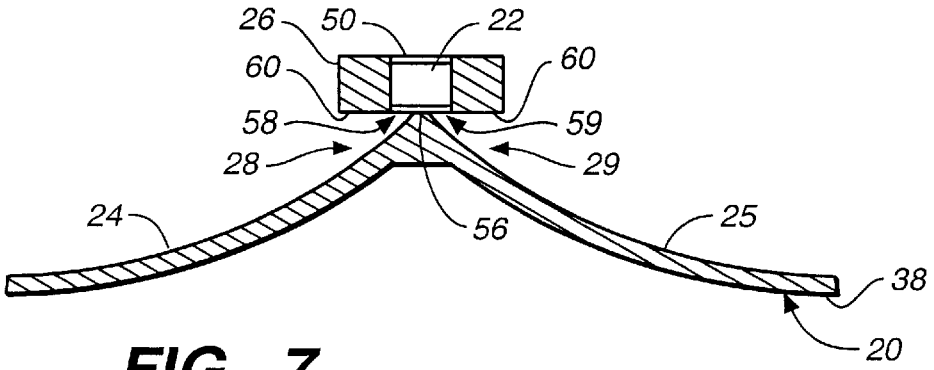
FIG. 7 is a cross-sectional view taken along line 7—7 of FIG. 2A.

For purposes of description herein, the x, y, and z directions are defined in FIG. 1. The x-direction is defined as being across the housing 38 in the general direction of the length of the barrier element 26. This direction is described as being in the "general" direction because the barrier element 26 is tapered from its first end 42 to its second end 44. The x-direction therefor is in the direction of a centerline running along the length of the barrier element. The barrier element 26 is wider at first end 42 so that a user speaking into the headset can rest their cheek against the wider end, however, the barrier element does not have to be wider at one end. The barrier element 26 has an opening 34 in first end 42 for receiving the boom 32 upon which it is mounted. Opening 50, as best seen in FIGS. 2B and 7, through the barrier element 26 houses the microphone 22. Wires (not shown) extend from the microphone 22 through the barrier element 26 and the opening 34 into the boom 32.

Figure 8:
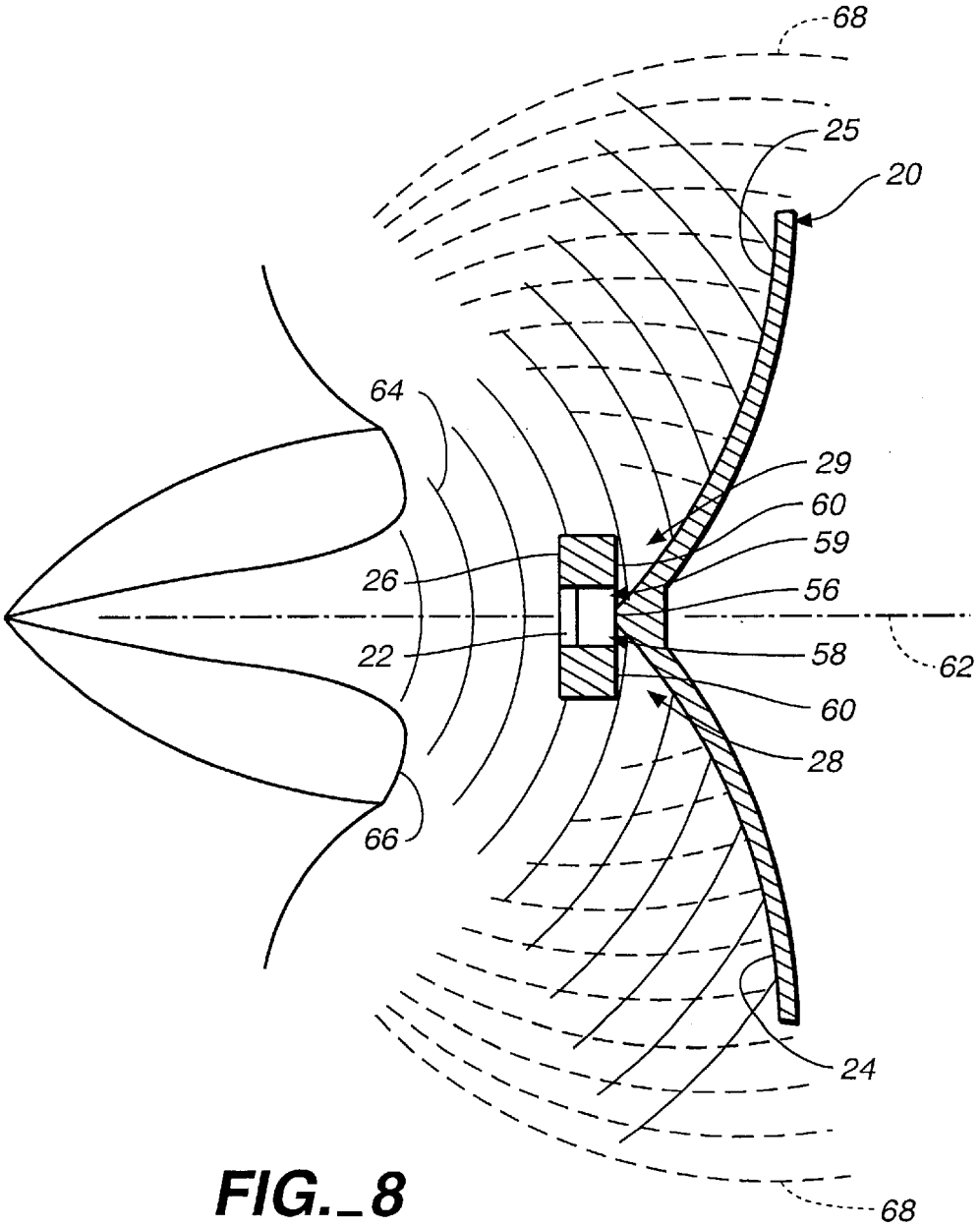
FIG. 8 is a diagrammatic representation of the speaker's voice interacting with the apparatus.

Curved reflectors 24 and 25 curve in the y and z directions (i.e., in the depth and height directions) until reaching an apex 56 (FIGS. 2B, 7–9) along the centerline of the barrier element 26. The curved reflectors 24 and 25 decrease in steepness as they sweep outward from the apex 56, thus forming a continuously variable curved surface. The continuously variable curved surfaces do not have to conform to a simple mathematical equation and can be semi-parabolic, quasi-parabolic, or any of a large variety of continuously variable curved surfaces. In furtherance of eliminating or minimizing resonance, the back side or underside 60 of the barrier element 26 and the intersection of the curved reflector form non-tubular sound concentration zones 28 and 29 around the slots 58 and 59 (FIGS. 7 and 8). In other words, the space bounded by the underside of the barrier element and the curved reflector does not form a column of air as the tubular structures of the prior art often do which can produce resonance at certain frequencies. Rather the sound concentration zones 28 and 29 are "open" reflector systems similar to the human ear so as to eliminate or at least minimize resonance around the slots 58 and 59.

Figure 9:
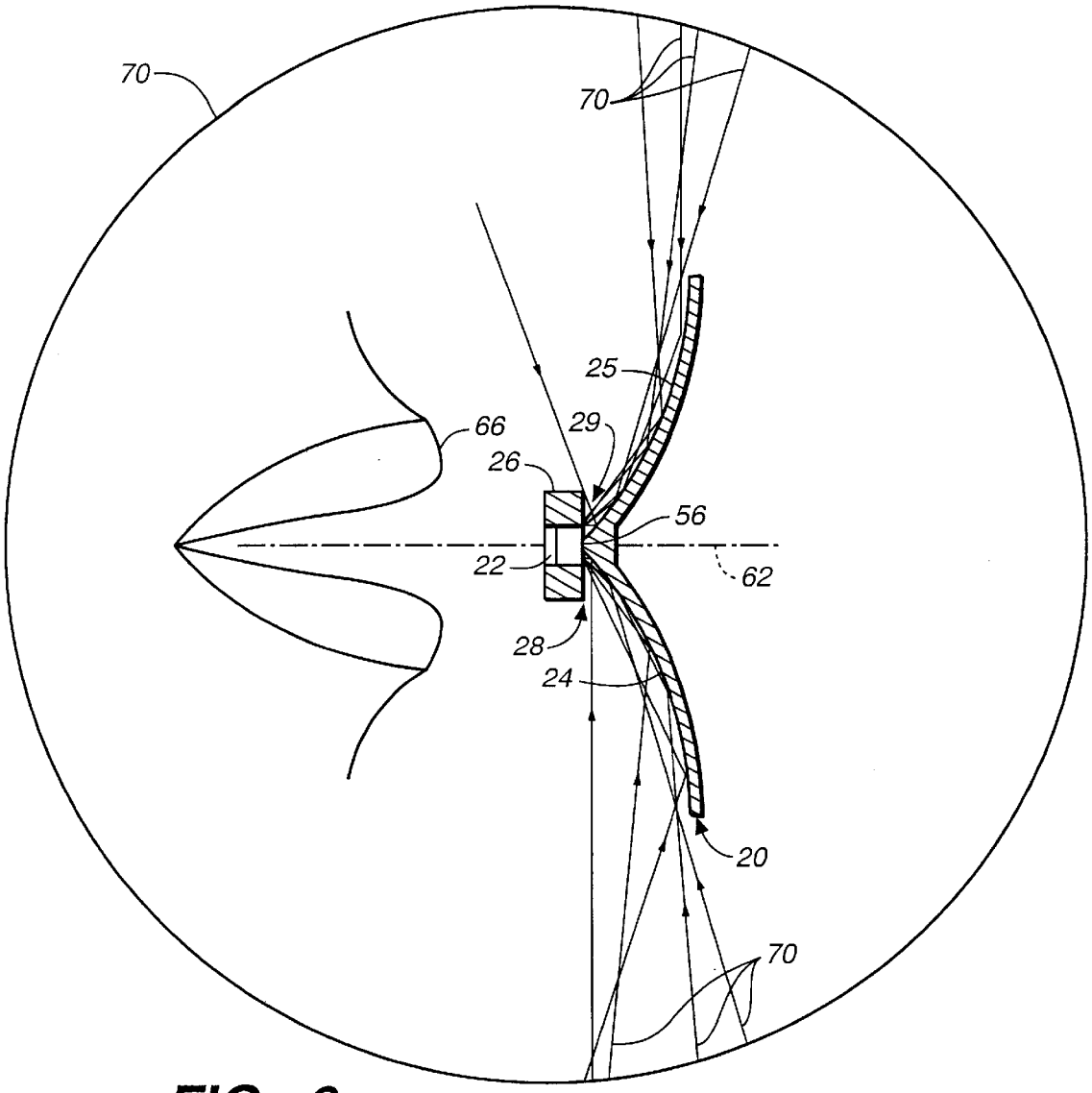
FIG. 9 is a diagrammatic representation of ambient noise interacting with the apparatus.

One purpose of the curved reflectors 24 and 25 is to reflect and concentrate ambient noise through slots 58 and 59 onto the back side of the microphone 22. Slots 58 and 59 (FIG. 7) are formed where the opening 50 exits through the barrier element 26 onto the apex 56. The continuously variable curved surfaces of the reflectors 24 and 25 help to ensure for each angle of incidence of ambient noise 70 (FIG. 9) there is some angle of reflection for directing the ambient noise 70 to the back side of the barrier element 26, the slots 58 and 59, and the back side of the microphone 22 (FIG. 9). In addition, because the curved reflectors 24 and 25 are much larger relative to the slots 58 and 59, the reflectors increase the sound pressure of the ambient noise on the sound-receiving back side of the microphone 22 to overcome the inherent acoustical impedance of the internal support structure of the microphone so that the ambient noise impinges on the sound-receiving front side and sound-receiving back side of the microphone diaphragm at substantially equal sound pressures for better noise-cancellation.

Another purpose of the curved reflectors 24 and 25 is to reflect the talker's voice away from the back side of the microphone 22 so as to reduce or eliminate self-cancellation of the speaker's voice which is caused by the speaker's voice entering both the front and back side of the microphone. As shown in FIG. 8, the voice 64 (solid wavefront lines) of the talker 66 is directed toward the top of the barrier element 26 generally along the main axis 62 of the apparatus 20 into the front entrance of the microphone. After the voice sound 64 passes the barrier element, it is reflected away from the rear entrance of the microphone by reflectors 24 and 25 (dashed wavefront lines 68). Reflecting the voice 64 of the talker 66 away from the back side of the microphone can produce a 10 dB gain over prior art headsets because prior art headsets typically have some self-cancellation of the talker's voice. To decrease the amount of the talker's voice that might pass around the edges of the barrier element 26, the shape of the edges can be optimized to reduce refraction around the edges or to reflect the speaker's voice away. The reflectors 24 and 25 can be any of a large variety of materials such as but not limited to plastics, foams and rubbers.

One way to cancel the effect of the noise pressure on the microphone is to ensure that the noise pressure felt by the front surface is equal to that felt by the rear surface. In FIG. 9, the noise 70 is modeled as a distributed spherical source having intensity $I_O$. The spherical noise source is assumed to be located at a radius R from the center of the microphone 22. The noise pressure felt on the front surface of the microphone is obtained by integrating the noise field over the upper hemisphere:

$$N_f = \frac{I_O A \pi}{8c}$$

where A is the surface area of the microphone, c is the speed of sound in air and $N_f$ is the noise pressure impinging on the front surface of the microphone.

The noise pressure felt on the rear surface of the microphone depends on the reflector characteristics. For an isotropic, linearly elastic solid reflector, the acoustic reflectively $\alpha_r$ is given by:

$$\alpha_r = \frac{1 - 4\rho_1 c_1 \rho c \cos\theta \sqrt{1 - \left(\frac{c}{c_1}\right)^2 \sin^2\theta}}{\rho c \cos\theta + \rho_1 c_1 \sqrt{1 - \left(\frac{c}{c_1}\right)^2 \sin^2\theta}}$$

where ρ is the density of air, c is the speed of sound in air, $\rho_l$ is the density of the reflector medium, $c_1$ is the speed of sound in the reflector medium, and θ is the angle of incidence. Careful study indicates that the acoustic reflectivity is nearly unity for most metallic solids. Other material chosen for the reflector of the present invention can also have a reflectivity of unity. Applying Snell's law, the noise pressure due to reflection is:

$$N_b = \int_0^L \frac{2\pi I_O}{c} \sqrt{1 + \left(\frac{df}{dx}\right)^2}\, 2\pi x \left(1 - \frac{f}{\sqrt{\frac{Af}{n\sqrt{f^2 + x^2}} + x^2}}\right) dx$$

where y=f(x) is the function that determines the shape of the reflector. This function is chosen such that $N_f = N_b$. Several families of functions satisfy the given noise-pressure-matching criterion. Of these families, functions are chosen that satisfy three criteria. The first criterion is the frequency range for which noise cancellation is desired. For the current speech application, a frequency range of 0 to 8,000 KHz is desired. By comparing the unreflected wave impinging on the front surface with the reflected wave impinging on the rear surface it can easily be shown that the reflected wave lags behind the unreflected wave. Therefore, the shape function is chosen such that the phase lag is minimal. The second criterion is that the shape minimizes the amount of near field sound reflected back to the microphone and the third is that the surface is easily manufacturable.

Noise rejection or cancellation is measured by comparing the signals of a reference microphone to a test microphone under two conditions. The first condition subjects both microphones to a close proximity sound (i.e., near field) to simulate a person speaking into the microphone at close range. The second condition subjects both microphones to ambient room noise (i.e., far field). The difference between the responses of each microphone to the two conditions is a measure of the microphone's noise rejection or cancellation effectiveness. The present invention was tested against a prior art noise-canceling headset. The present invention and the prior art headset each utilized identical microphone elements (i.e., electrets). The response of the prior art device is plotted in FIG. 10 and the response of the present invention is plotted in FIG. 11.

Both microphones were tested for noise rejection by comparing each response to that of a Peavey ERO 10 reference microphone which has no noise rejection characteristics but exhibits a well defined flat response from 20 Hz to 20 KHz. The reference microphone and the test microphone were placed in very close proximity to each other equidistant from a noise source. A near field sound source was provided by an acoustic dummy of human dimensions with a JBL Control Micro loudspeaker mounted inside the head. The loudspeaker generated sound which exited through the mouth opening. The reference microphone and the test microphone were placed 2 centimeters from the mouth opening. A far field ambient noise source was provided by another JBL Control Micro loudspeaker mounted on a movable stand about 10 feet away from the dummy.

A Hewlett-Packard 3566 two channel dynamic spectrum analyzer was used for source noise and measurement. A white noise signal of 300 millivolts was amplified (McGowen 354SL) and connected to the dummy loudspeaker. The sound pressure was adjusted to 80 dB at the test microphone and reference microphones. The microphone signals were routed to the analyzer through a Makie 1202 mixer with the reference microphone routed to channel one and the test microphone routed to channel two. With the analyzer in frequency response mode, the two signals were analyzed by the Hewlett-Packard 3566 which automatically divided their power outputs.

After plotting the near field response, the amplifier was switched to the far field loudspeaker and without moving the microphones, the sound pressure was again adjusted to 80 dB at the test microphone and reference microphone. This required turning up the amplifier volume because of the added distance between the loudspeaker and the microphones. The far field response was plotted to measure how much less responsive each microphone was to distant sounds. The difference between the near field and the far field response is a measure of the microphone's noise rejection.

Figure 10:
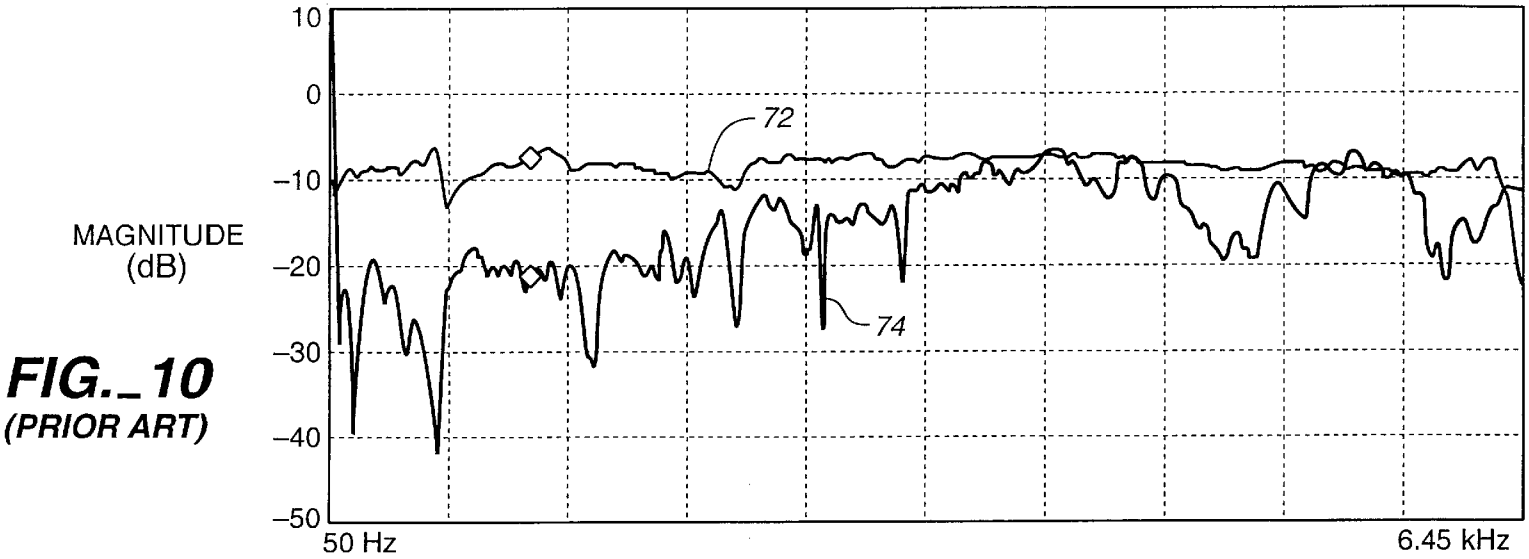
FIG. 10 (PRIOR ART)
FIG. 10 is a graph of the near field response and far field response of a prior art noise canceling headset.

In FIG. 10, the upper trace 72 is the near field response of the prior art headset. The prior art headset followed approximately the −10 dB magnitude line throughout the frequency range of 50 Hz to 8 KHz indicating the prior art headset had a fairly flat response but 10 dB less gain than the reference microphone. The lower trace 74 is the far field response of the microphone which varied between about 10 and 20 dB up to about 3.5 KHz at which point it began to "poop out" because at this "crossover" frequency, the distance between the front and the rear port is equal to one-half of the wavelength $\lambda$. The curved reflectors overcome this by bringing sound waves to both ports nearly in phase.

Figure 11:
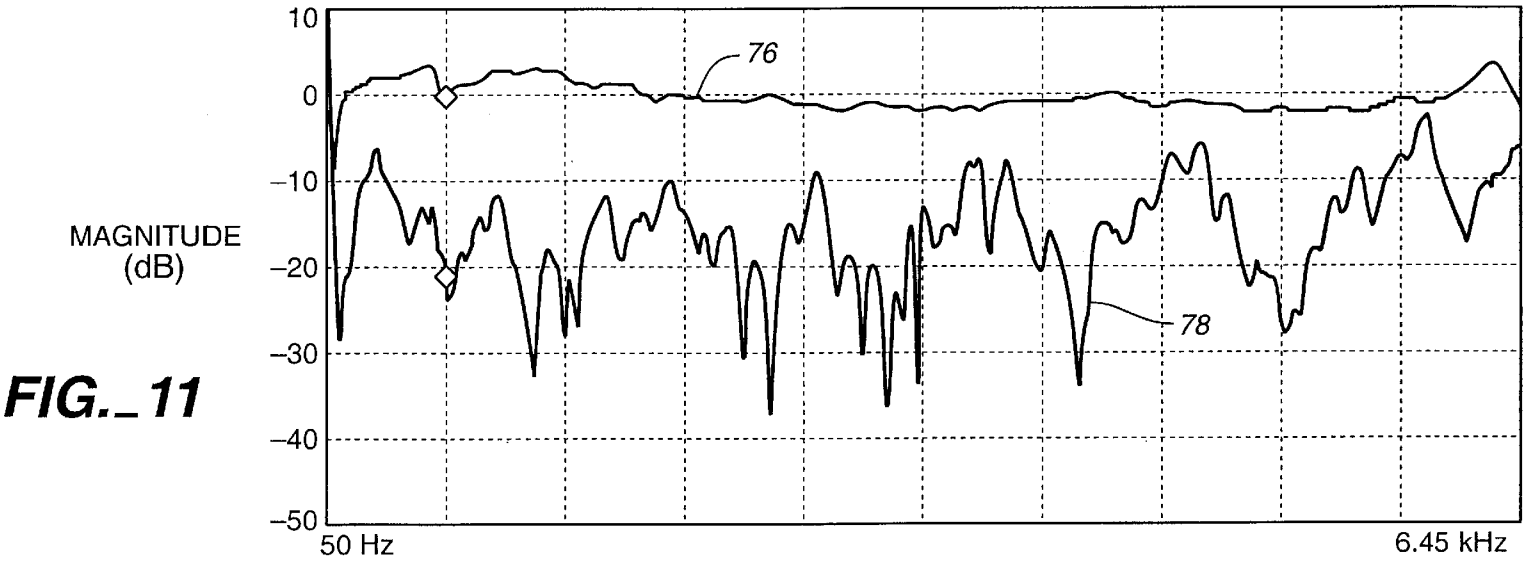
FIG. 11 is a graph of the near field response and far field response of the apparatus of the present invention.

In FIG. 11, the same microphone element was tested in a headset with the apparatus of the present invention following the same procedure. The near field response 76 followed the 0.0 dB line indicating that the headset with the present invention nearly had the same gain as the reference microphone. In addition, the noise rejection of the apparatus of the present invention was dramatically greater, ranging between 10 dB to 40 dB up to 6.45 KHz and beyond as shown by the lower trace 78.

It will be appreciated by those of ordinary skill in the art that the present invention can be embodied in other specific forms without departing from the spirit or essential character thereof. The presently disclosed embodiments are therefore considered in all respects to be illustrative and not restrictive. The scope of the invention is indicated by the appended claims rather than the foregoing description, and all changes which come within the meaning and range of equivalents thereof are intended to be embraced therein.

We claim:

1. A noise-controlling apparatus for use with a directional microphone comprising:

a boom; and a housing mounted on the boom, the housing having a first sound opening located in a front side of a barrier element and a second sound opening located in a back side of the barrier element, the housing having a curved reflector extending from the back side of the barrier element which reflects a user's voice away from the second sound opening and reflects ambient noise toward the second sound opening.

2. The apparatus of claim 1 wherein the boom is attached to a headset.

3. The apparatus of claim 1 wherein the back side of the housing is configured so as to have a curved surface shaped generally the same as the curved reflector.

4. The apparatus of claim 1 wherein the curved reflector comprises a semi-parabolic curved surface.

5. The apparatus of claim 1 wherein the curved reflector comprises a quasi-parabolic curved surface.

6. The apparatus of claim 1 wherein the back side of the barrier element and the curved reflector form a non-tubular sound concentration zone around the second sound opening.

7. The apparatus of claim 1 wherein the curved reflector curves in the y and z directions only.

8. The apparatus of claim 1 wherein the curved reflector curves in the depth and height directions only.

9. A noise-controlling apparatus comprising:

a boom;

a microphone having a sound-receiving front side and a sound-receiving back side;

a housing mounted on the boom, the housing having a centrally located barrier element with a first sound opening in a front side of the barrier element and a second sound opening in a back side of the barrier element communicating with the sound-receiving front and back side, respectively, of the microphone; and means for reflecting a user's voice away from the second sound opening and reflecting ambient noise toward the second sound opening.

10. The apparatus of claim 9 having means forming a non-tubular sound concentration zone around the second sound opening.

11. The apparatus of claim 9 having means for increasing the sound pressure from the ambient noise on the sound-receiving back side of the microphone.

12. The apparatus of claim 9 having means for preventing or minimizing resonance at the second sound opening.

13. The apparatus of claim 9 wherein the boom is attached to a headset.

* * * * *